US006247616B1

(12) United States Patent
Weiler et al.

(10) Patent No.: US 6,247,616 B1
(45) Date of Patent: Jun. 19, 2001

(54) CAP WITH DRAINING SPIKE AND FLIP TOP FOR USE WITH HERMETICALLY SEALED DISPENSING CONTAINER

(75) Inventors: Gerhard H. Weiler, South Barrington; Kristian Schaeffer, Schaumburg, both of IL (US)

(73) Assignee: Automatic Liquid Packaging, Inc., Woodstock, IL (US)

( * ) Notice: Subject to any disclaimer, the term of this patent is extended or adjusted under 35 U.S.C. 154(b) by 0 days.

(21) Appl. No.: 09/569,917

(22) Filed: May 11, 2000

Related U.S. Application Data

(60) Division of application No. 08/976,305, filed on Nov. 21, 1997, now Pat. No. 6,076,704, which is a continuation-in-part of application No. 08/476,090, filed on Jun. 7, 1995, now Pat. No. 5,711,453.

(51) Int. Cl.[7] ..... B67D 5/00
(52) U.S. Cl. ..... 222/83; 222/541.2; 222/543
(58) Field of Search ..... 222/83, 91, 206, 222/541.2, 543, 562, 568

(56) References Cited

U.S. PATENT DOCUMENTS 4,090,647 * 5/1978 Dunning ..... 222/543
4,583,668 * 4/1986 Maynard, Jr. ..... 222/543
5,154,327 * 10/1992 Long ..... 222/543
5,711,453 * 1/1998 Weiler ..... 222/83
6,076,704 * 6/2000 Weiler et al. ..... 222/541.2

* cited by examiner

*Primary Examiner*—Philippe Derakshani
(74) *Attorney, Agent, or Firm*—Olson & Hierl, Ltd.

(57) ABSTRACT

A cap equipped with a dispensing nozzle is provided for use with a hermetically sealed container which includes a body portion and a neck portion sealed by a pierceable membrane. A spike within the cap pierces the membrane when the cap is threaded onto the neck portion of the container so as to provide access to the contents of the container. The spike includes a passageway in fluid flow communication with a dispensing nozzle on the cap so as to allow dispensing of the contents of such container. In one cap embodiment, the draining spike is an element nestable within the cap which is made of a relatively harder material than the cap. In another cap embodiment, the draining spike is unitary with the cap and made of the same relatively harder material as the cap. A flip top assembly is also provided including a flip top which covers the dispensing nozzle to seal the cap. The flip top is retained on the dispenser by a flexible arm which is unitary with the cap or with a ring. The ring can be fitted either around the nozzle on a boss defined by the nozzle or around the neck portion and between the cap and the body portion.

15 Claims, 4 Drawing Sheets

FIG. 1
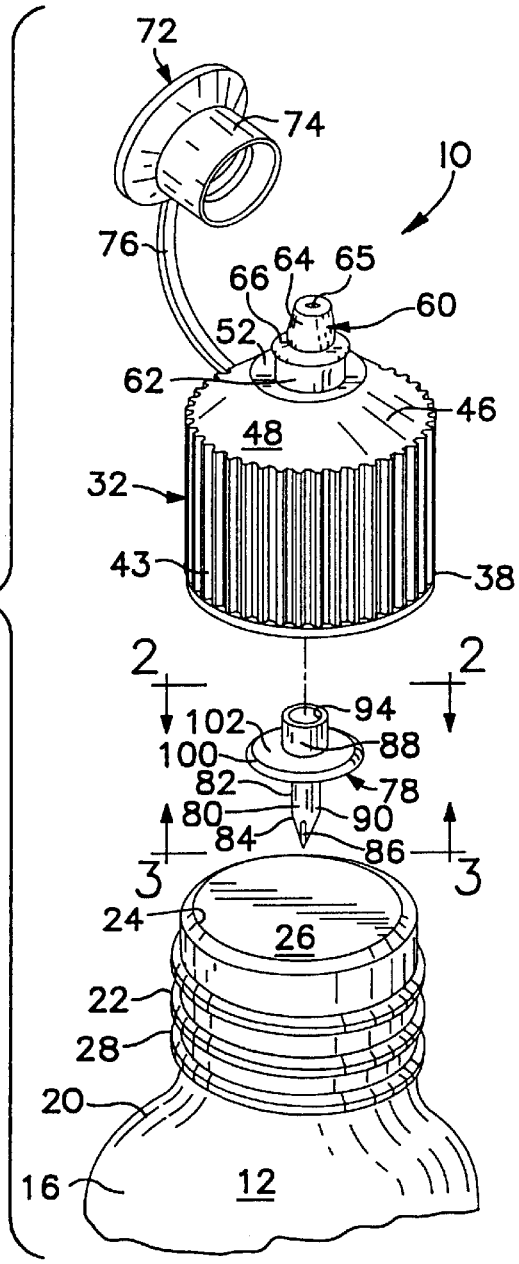
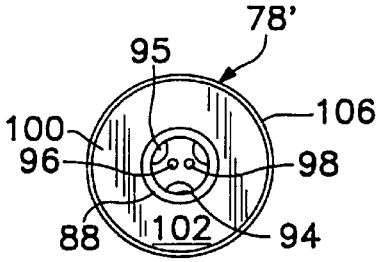
FIG. 2
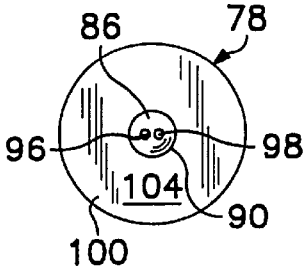
FIG. 3

CAP WITH DRAINING SPIKE AND FLIP TOP FOR USE WITH HERMETICALLY SEALED DISPENSING CONTAINER

RELATED APPLICATION

This application is a division of application Ser. No. 08/976,305, filed Nov. 21, 1997, which now is U.S. Pat. No. 6,076,704, in turn, is a continuation-in-part of application Ser. No. 08/476,090, filed Jun. 7, 1995, now U.S. Pat. No. 5,711,453.

TECHNICAL FIELD OF THE INVENTION

This invention relates to a hermetically sealed dispensing container having a unitary sealing membrane and, more particularly, to a dispensing cap therefor having a flip top and a draining spike therein which pierces the container membrane as the cap is secured to the container so as to provide access to the container contents.

BACKGROUND OF THE INVENTION

Packaging systems that blow, fill, and seal containers such as thermoplastic bottles enjoy widespread commercial acceptance through ease of operation and reduced labor costs. A container or bottle of this type is formed of thermoplastic material, filled with the desired substance, and then sealed in one continuous operation as disclosed in U.S. Pat. No. 4,178,976 to Weiler et al. Generally, the container is sealed by a pierceable membrane which is unitary with an opening defined by the throat or neck portion of such container. Such a packaging system obviates the need for costly auxiliary equipment to clean and handle empty containers, fill the containers, and seal the containers. The system is particularly desirable where a sterilized fluid is to be sealed within a container and thereafter maintained in a sterile condition.

However, some means must be provided to pierce the membrane and obtain access to the contents within the container. Access to the contents is presently accomplished by first piercing the membrane with a suitable instrument such as a knife or the like so as to provide access to the container contents and then securing a cap with a dispensing nozzle over the neck portion to allow dispensing of the container contents. This means, however, is undesirable in medical applications and, particularly, in emergency medical applications where time is of the essence since the present means is a two-step process. Moreover, this means is undesirable because the membrane may often times be pierced with a non-sterile instrument thus increasing the likelihood that the sterile contents of such container may be contaminated.

It would be desirable if the membrane could be pierced with a sterile instrument substantially concurrently with the securement of the cap to the container. Also, it would be desirable to provide a container closure to seal the dispensing nozzle after the membrane has been pierced. The present invention meets these desires.

SUMMARY OF THE INVENTION

A new and useful dispensing cap is provided for use in connection with a hermetically sealed thermoplastic container which has a hollow body portion which terminates into a threaded neck portion defining an opening sealed with a membrane unitary therewith. The cap is threadedly secured over the neck portion of the container and is provided with a dispensing nozzle. A draining spike is located within the cap and is adapted for piercing the membrane when the cap is secured to the neck portion so as to provide access to the interior of the body portion. The draining spike is in fluid flow communication with the dispensing nozzle so as to allow the dispensing of the container contents.

Preferably, the cap includes a dome portion from which the dispensing nozzle outwardly extends and from which the draining spike downwardly depends.

In one cap embodiment, the dome portion defines an inner recess and the dispensing nozzle includes an inner channel. In this embodiment, the draining spike is an element separate from the cap which is made of a relatively harder material than the cap and which comprises an elongated member including a generally cylindrical body portion and a conical pointed tip or piercing portion which extends away from the body portion and a peripheral flange. The cylindrical body portion and peripheral flange are nested within the channel and recess respectively thereby securing the spike within the cap.

In an alternate cap embodiment, the draining spike is unitary with the cap and comprises a cylindrical body portion which extends unitarily downwardly from the dome portion of the cap and a conical pointed tip or piercing portion which extends away from the body portion. In this embodiment, both the draining spike and the cap are made of the same relatively harder material.

Because the spike is located within the cap, the membrane can be pierced at the same time that the cap is being secured to the container thus eliminating the step of piercing the membrane prior to securement of the cap to the container. The draining spike is made of a material such that it does not bend or break during piercing of the membrane. Moreover, the use of a spike within the cap allows the membrane to be pierced with a sterile instrument thus assuring the continued sterility of the container contents.

To provide container closure after the membrane has been pierced by the draining spike, a removable flip top assembly is provided which includes a flip top which fits over the dispensing cap to seal the dispensing nozzle, a flexible arm unitary with the flip top and a retaining ring for the arm and the top. The retaining ring can be mounted to the dispensing nozzle or to the container, as desired.

There are other advantages and features of the present invention which will be more readily apparent from the following detailed description of the preferred embodiment of the invention, the drawings, and the appended claims.

BRIEF DESCRIPTION OF THE DRAWINGS

In the drawings,

FIG. 1 is an exploded fragmentary perspective view of a dispenser embodying this invention and showing a hermetically sealed container in association with a cap with a flip top container closure and a draining spike adapted to fit within the cap;

FIG. 2 is an enlarged top plan view of the draining spike taken generally along the plane 2—2 of FIG. 1;

FIG. 3 is an enlarged bottom plan view of the draining spike taken generally along the plane 3—3 of FIG. 1;

DESCRIPTION OF THE PREFERRED EMBODIMENTS

Figure 4:
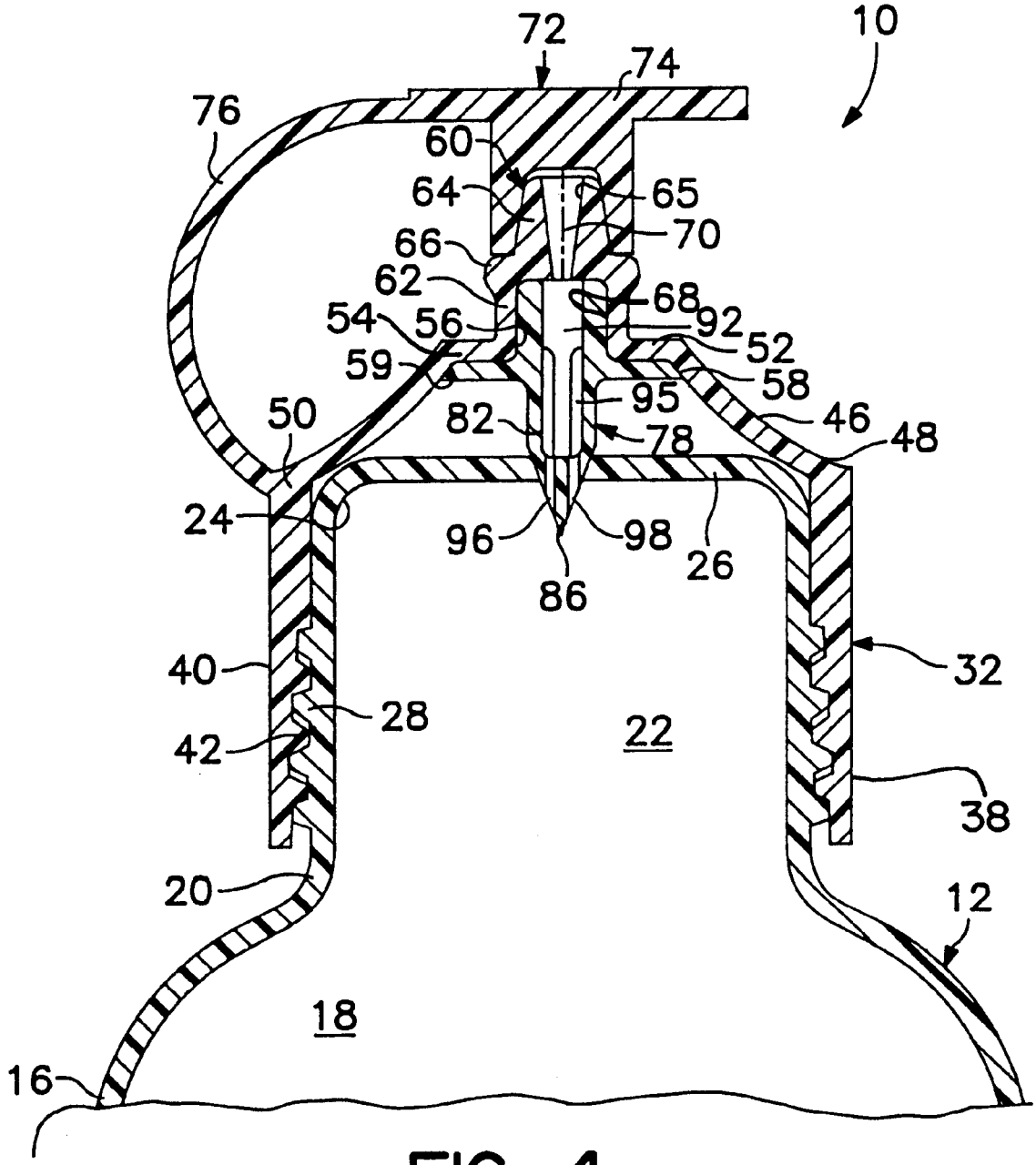
FIG. 4 is an enlarged fragmentary cross-sectional view of the dispenser showing the cap threaded and secured to the neck portion of the container, the spike therein piercing the container membrane and the flip top closure seated over the dispensing nozzle.

The invention disclosed herein is, of course, susceptible of embodiment in many different forms. Shown in the drawings and described hereinbelow in detail are preferred embodiments of the invention. It is to be understood, however, that the present disclosure is an exemplication of the principles of the invention and does not limit the invention to the illustrated embodiments.

For ease of description, a dispenser constituted by a container equipped with the caps and their respective flip top closures embodying the present invention is described hereinbelow in its usual assembled position as shown in the accompanying drawings and terms such as upper, lower, horizontal, etc., will be used herein with reference to this usual position. However, the container, caps, and flip tops may be manufactured, stored transported, sold, or used in orientations other than that described and shown herein.

Referring now to FIGS. 1 and 4, dispenser 10 embodying this invention comprises a hermetically sealed container 12 and a cap 32 associated therewith. Container 12 is of unitary construction and includes a hollow body portion 16 whose walls are relatively thin and which define a liquid-holding cavity 18. Body portion 16 and cavity 18 can have any convenient or desired configuration. The container configuration shown, however, is presently preferred, particularly with the body portion 16 sized to fit into the palm of the average or typical adult human hand. The walls of body portion 16 are relatively thin so that body portion 16 can be manually squeezed, i.e., compressed or distorted to dispense a liquid fill therefrom.

Container 12 can be molded using a thermoplastic polymer. Presently preferred polymers are low density polyethylene (LDPE), high density polyethylene (HDPE), polypropylene (PP), and the like. The thickness of body portion 16 can vary from one location to another, but is preferably formed as thin as practical, consistent with structural strength requirements.

Container 12 can be made by a parison molding procedure wherein body portion 16 is formed first, then filled with a desired liquid fill, and thereafter sealed with a pierceable membrane. The blow, filling and sealing operations are carried out automatically under sterile conditions using procedures known to the art as disclosed in the aforementioned U.S. Pat. No. 4,178,976 to Weiler et al.

The cap 32 of the present invention can be fabricated with automatic molding apparatus and other mechanisms, the details of which, although not fully illustrated or described, will be apparent to those having skill in the art and an understanding of the necessary functions of such apparatus and mechanisms. The detailed descriptions of such apparatus and mechanisms are not necessary to an understanding of the invention and are not herein presented because such apparatus and mechanisms form no part of the present invention.

Referring back to FIGS. 1 and 4, one end 20 of body portion 16 terminates in a tapered neck or throat portion 22 which is unitary with body portion 16. The neck portion 22 defines an opening 24 sealed with a pierceable membrane 26 unitary therewith. The neck portion 22 and body portion 16 are usually positioned substantially symmetrically about a common longitudinal axis.

External screw threads 28 are formed about the periphery of neck portion 22. The threads 28 extend circumferentially outwardly about an outside wall region of neck portion 22. Screw threads 28 can be left-handed or right-handed, as desired.

The cap 32 includes a skirt portion 38 defined by a generally cylindrical peripheral wall 40. The wall 40 is provided with internal screw threads 42 about an inside surface region thereof. The cap screw threads 42 are threadingly engageable with the neck portion screw threads 28. In the embodiment illustrated, the exterior surface of the wall 40 is generally cylindrical, but it also has a plurality of vertically aligned grooves 43 to facilitate gripping of the cap 32. Other gripping means are suitable as well.

The cap 32 also includes a unitary dome portion 46 comprising a frustoconical wall 48 which projects unitarily upwardly from a distal terminus 50 of the skirt portion 38. The dome portion 46 also includes a circular cross wall 52 which projects unitarily horizontally from a distal terminus 54 of frustoconical wall 48. The cross wall 52 includes a centrally disposed circular aperture or opening 56 and a cylindrical recess 58 concentric with the aperture 56. The recess 58 includes a tapered lateral peripheral surface 59.

Moreover, the cap 32 includes a dispensing nozzle 60 including a generally cylindrical portion 62 which projects unitarily longitudinally upwardly from the aperture 56 in cross wall 52 and a frustoconical portion 64 which projects unitarily convergently upwardly from the cylindrical portion 62 and which terminates into a dispensing orifice 65. An annular shoulder 66 is defined in the region between cylindrical portion 62 and frustoconical portion 64. A generally cylindrical channel 68 extends centrally axially from the aperture 56 through the cylindrical portion 62 of nozzle 60 and an upwardly divergingly tapered frustoconical channel 70 extends centrally axially through the frustoconical portion 64 between the channel 68 and orifice 65. The channels 68 and 70 are in fluid flow communication with each other.

The cap 32 can be made of a plastic material such as polypropylene, polyethylene, or the like and also includes a flip top assembly 72 including a flip top 74 adapted to be secured over the nozzle 60 and a flexible arm 76 extending unitarily between the flip top 74 and the skirt portion 38. In the embodiment illustrated in FIGS. 1 and 4, the flexible arm 76 extends unitarily between the flip top 74 and the terminus 50 of the skirt portion 38 and the flip top assembly is removable together with the cap 32.

A draining spike 78 is made of relatively harder material than the cap 32 and is located within the cap 32 for piercing the membrane 26 when the cap 32 is threadingly secured to the neck portion 22. This provides access to the liquid within body portion 16 of container 12.

In the particular embodiment of FIGS. 1–4, spike 78 is an element separate from the cap 32. Spike 78 comprises an elongated member 80 with a generally cylindrical body portion 82 which terminates at a distal end 84 thereof into a pointed conical tip or piercing portion 86. The cylindrical body portion 82 is comprised of a first generally cylindrical segment 88 and a second generally cylindrical segment 90 unitary and integral with the first segment 88 but having a diameter less than the diameter of first segment 88. The body portion 82 includes a bore 92 which extends centrally axially therethrough and terminates into an aperture 94 at the end of the first segment 88. A plurality of fins 95 extend longitudinally around the circumference of the bore 92. The tip portion 86 includes diametrically opposed inner passages 96 and 98 which extend longitudinally between the outer surface of piercing portion 86 and the bore 92. The bore 92, in fluid flow communication with the passages 96 and 98, defines a draining passageway. The draining spike 78 can be made of harder plastic material such as styrene, acrylonitrile-butadiene-styrene (ABS), and the like. However, as discussed in greater detail hereinbelow, the draining spike such as spike 78 can also be made unitary with the cap.

Referring again to FIGS. 1–4, the spike 78 also includes a flange 100 extending outwardly around the periphery of body portion 82 in the region between the first and second segments 88 and 90 respectively. The flange 100 includes an upper surface 102 and a lower surface 104 interconnected by a tapered lateral face 106.

Spike 78 is secured within the cap 32 and, more particularly, depends inwardly from the dome portion 46 thereof such that the first segment 88 of body portion 80 is nested within the channel 68 of nozzle 60 and the flange 100 is nested within the recess 58 in cross wall 52 and the second segment 90 and piercing portion 86 extend inwardly into the interior of cap 32. In the nested position, the tapered lateral surface of recess 58 engages the lateral tapered face 106 of flange 100 so as to provide a press fit of the spike 78 within cap 32. Moreover, in the nested position, the bore 92 of spike 78 is in fluid flow communication with the channel 68 in nozzle 60.

Liquid is dispensed from the container 12 as described below. Initially, cap 32 is positioned over the neck portion 22 so as to begin threadable engagement between respective screw threads 28 and 42. The cap 32 is then rotated, relative to the neck portion 22 in a direction which increases the amount of such threadable engagement and causes the spike 78 to move towards the membrane 26, until the cap 32 is fully threaded onto the neck portion 22 and the piercing portion 86 of spike 78 has penetrated the membrane 26 as shown in FIG. 4 thus providing an access to the liquid in the body portion 16 of container 12.

Then, upon squeezing and/or tilting of the container 12, the liquid in body portion 16 may be dispensed through the nozzle 60 via passages 96 and 98 and bore 92 in spike 78 and channels 68 and 70 and dispensing orifice 65 in nozzle 60.

The cap 32 of the present invention including a separate, nestable, draining spike 78 is particularly applicable where the cap is made of a relatively softer material. The draining spike 78 then must be made of a material harder than the cap 32 to assure that the draining spike 78 does not bend or break during the piercing of the membrane 26. As a result, in this particular embodiment the draining spike 78 is an element separate from the cap 32.

Moreover, in the application where cap 32 is made of a relatively soft material, threads 42 therein also define seal gaskets which sealingly engage the threads 28 of neck portion 22 to prevent the leaking of the liquid container contents between the cap 32 and the neck portion 22 while the liquid container contents are dispensed.

Figure 7:
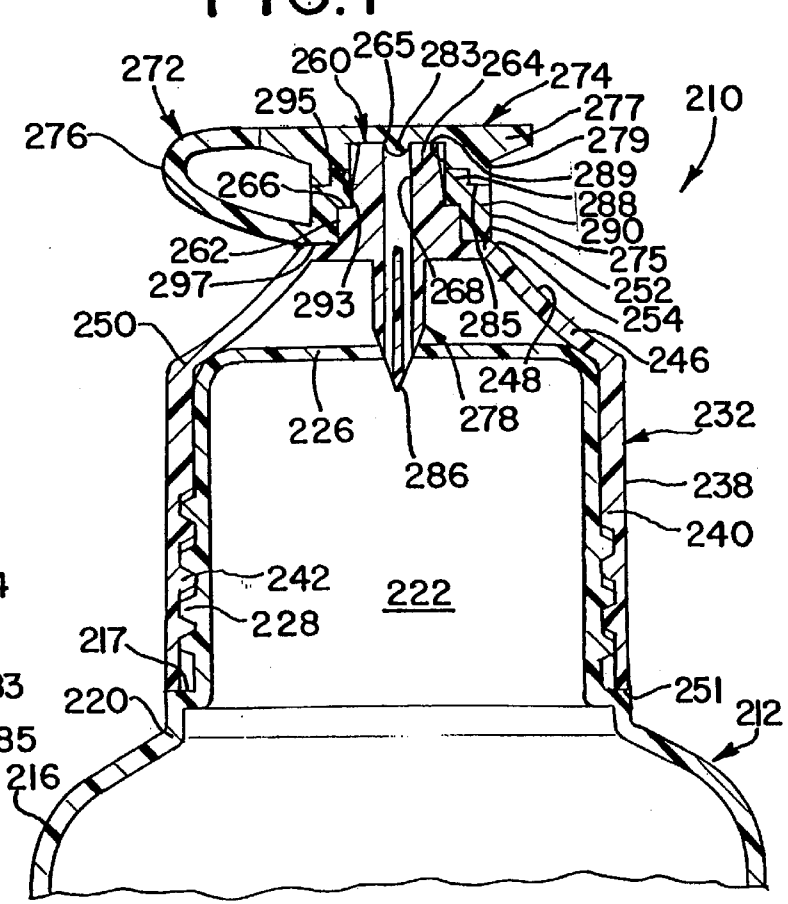
FIG. 7 is an enlarged fragmentary cross-sectional view of a dispenser showing the cap of FIG. 5 threaded and secured to the neck portion of the container, the spike therein piercing the container membrane, and the flip top assembly secured to the dispensing nozzle of the cap.
Figure 6:
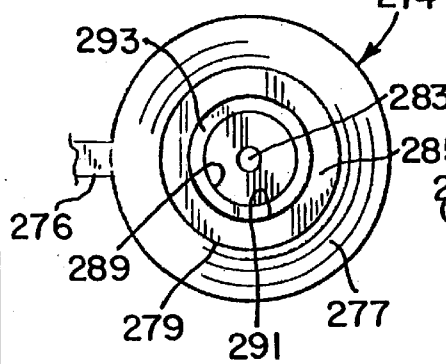
FIG. 6 is an enlarged fragmentary bottom plan view of the flip top taken generally along the plane 6—6 of FIG. 5.
Figure 5:
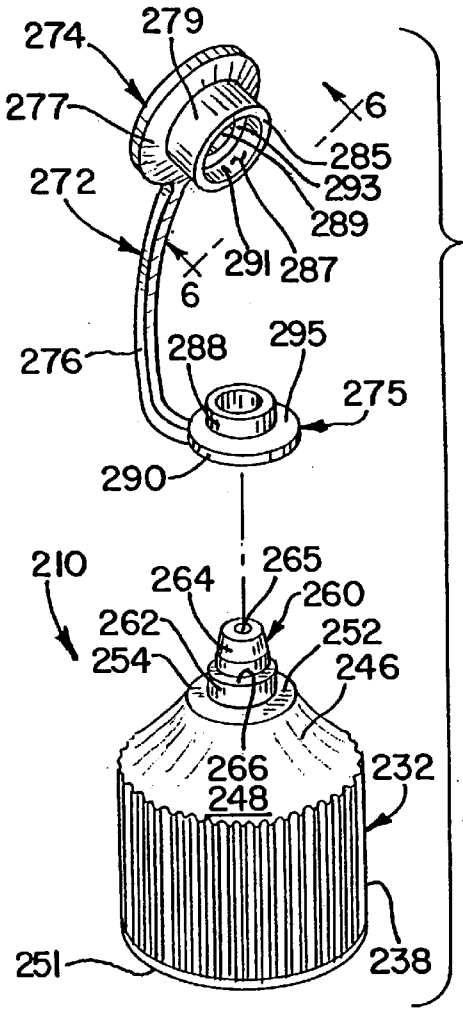
FIG. 5 is an exploded perspective view of another embodiment of a cap embodying the invention and showing the cap in association with a flip top assembly.

FIGS. 5–7 show an alternate dispenser embodiment 210 embodying this invention comprising a hermetically sealed container 212, a cap 232, and a flip top assembly 272 associated therewith.

Container 212 is similar to container 12 except that container 212 additionally includes a circumferentially and radially outwardly extending shoulder 217 at the end 220 of body portion 216 (FIG. 7).

The cap 232 is similar to the cap 32 of container 12 but is made of a relatively harder material with unitary spike 278 and includes a cylindrical skirt portion 238 defined by a generally cylindrical wall 240 having a distal terminus 250 and a peripheral circumferential annular edge 251. The cap 232 also includes a unitary dome portion 246 comprising a frustoconical wall 248 which projects unitarily upwardly from the distal terminus 250 of skirt portion 238. The dome portion 246 also includes an annular cross wall 252 which projects horizontally from a distal terminus 254 of frustoconical wall 248 and is unitary therewith.

The cap 232 also includes a dispensing nozzle 260 having a generally cylindrical portion 262 which projects unitarily longitudinally upwardly from the top of circular cross wall 252 of dome portion 246 and a unitary frustoconical portion 264 which converges away from the top of cylindrical portion 262 and which terminates into a dispensing orifice 265. An annular shoulder 266 is defined in the region between cylindrical portion 262 and frustoconical portion 264. A generally cylindrical channel 268 defining a dispensing passageway extends centrally axially through the nozzle 260 and terminates into dispensing orifice 265.

Dispenser 210 also includes a flip top assembly 272 including a flip top 274 adapted to be mounted to the nozzle 260, a ring 275 having a terraced top surface 295 and a terraced bottom surface 297 and adapted to be seated over the annular shoulder 266 and the cylindrical portion 262, and a flexible elongate arm 276 which extends unitarily between and connects the flip top 274 and the ring 275.

The flip top assembly 272 is molded as a separate piece, made of a relatively softer material such as low density polyethylene (LDPE), high density polyethylene (HDPE), polypropylene (PP), and the like.

Flip top 274 includes a generally flat circular head 277 and a unitary cylindrical skirt 279 extending downwardly therefrom and defining a socket for receiving the nozzle 260 of cap 232. The head 277 includes a bottom surface from which a plug 283 outwardly protrudes. The arm 276 extends away from the peripheral edge of head 277. The skirt 279 includes a peripheral edge 285 and an inner cylindrical surface 287 (FIG. 5). Inner cylindrical surface 287 includes a first generally cylindrical portion 289 which projects unitarily outwardly from the bottom surface of head 277 and a second generally cylindrical portion 291 which projects unitarily outwardly from the end of cylindrical portion 289 and terminates into peripheral edge 285. An annular shoulder 293 is defined in the region between cylindrical portions 289 and 291.

The ring 275 of the flip top assembly 272 includes upper and lower concentric bosses 288 and 290. Upper boss 288 has a smaller outer diameter than lower boss 290 and projects outwardly from the lower boss 290. Both bosses 288 and 290 have an inner diameter dimensioned to fit around the nozzle 260 (FIG. 7). In addition, the lower boss 290 defines a counter bore that is dimensioned to be seated around the cylindrical portion 262 of the nozzle 260. The difference in outer diameters of the upper and lower bosses 288 and 290 defines the terraced top surface 295. The counter bore of the lower boss 290 and the concentric inner diameter of the upper boss 288 define the terraced bottom surface 297.

When the flip top assembly 272 is secured to the cap 232, the ring 275 is seated around the nozzle 260, as shown in FIG. 7. The terraced bottom surface 297 of the ring 275 complements and abuts the top of cross wall 252, the cylindrical portion 262, the shoulder 266, and the portion of the frustoconical portion 264 of the nozzle 260 that is adjacent to the shoulder 266. The counter bore and the inner diameter of the ring 276 are preferably dimensioned so that the ring 275 fits snugly around the nozzle 260. Thus, the ring 275 frictionally engages the nozzle 260 and flip top 274 can be secured to ring 275 on the nozzle with a snap-lock configuration while sealing dispensing orifice 265.

With the ring 275 seated on the nozzle 260, the flip top 274 is secured to the ring 275 as follows (FIG. 7). The peripheral edge 285 of the skirt 279 abuts the portion of the terraced top surface 295 that is defined by the lower boss 290. The annular shoulder 293 of the flip top 274 abuts the portion of the terraced top surface 295 that is defined by the upper boss 288. The inner cylindrical surface 287 of the second cylindrical portion 291 of the flip top 274 complements and frictionally engages the upper boss 288 of the ring 275. The plug 283 in the flip top 274 covers the dispensing orifice 265 of nozzle 260. The flip top 274 can be removed and replaced on the nozzle 260 as desired while retained on the cap 232 by flexible arm 276 which terminates into ring 275.

The flip top assembly 272 can be mounted to the nozzle 260 before or after the cap is attached to the container 212. For example, the flip top 274 can be seated on the ring 275, and then the flip top assembly 272 can be placed on the nozzle 260. This operation can be done before or after the cap 232 is secured to the container 212.

In use, liquid contained in container 212 is dispensed therefrom as described below. The cap 232 is positioned over neck portion 222 so as to begin threadable engagement between screw threads 228 and 242 on the neck portion 222 and cap 232, respectively. The cap 232 is then rotated relative to the neck portion 222, in a direction which increases the amount of such threadable engagement and causes draining spike 278 to move toward membrane 226, until the cap 232 is fully threaded onto neck portion 222 and piercing portion 286 of spike 278 has penetrated the membrane 226, as shown in FIG. 7, thus providing an access to the liquid in the body portion 216 of container 212.

When the cap 232 is fully threaded onto the neck portion 222 as described above, the annular edge 251 of the cap 232 abuts the shoulder 217 of the container 212. Thus, a visual indication is provided so that the user of the container and dispensing cap can determine whether the membrane has already been pierced and the container is ready to dispense the liquid therein.

Figures 8, 9, 10:
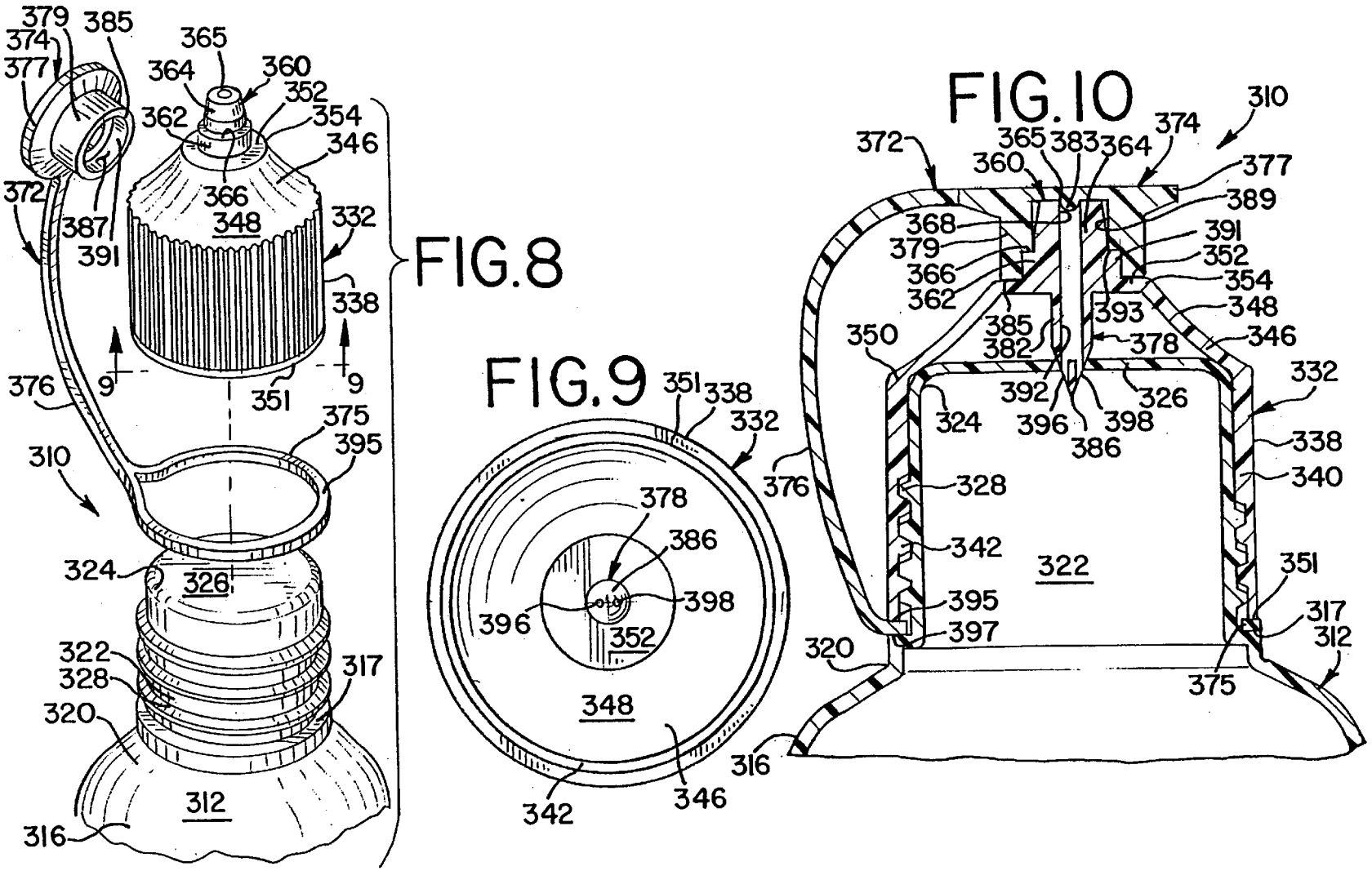
FIG. 8 is an exploded fragmentary perspective view of yet another embodiment of a dispenser embodying the invention and showing a hermetically sealed container in association with a cap and another embodiment of a flip top assembly.
FIG. 9 is an enlarged bottom plan view of the cap taken generally along the plane 9—9 of FIG. 8.
FIG. 10 is an enlarged fragmentary cross-sectional view of the dispenser of FIG. 8 showing the cap threaded and secured to the neck portion of the container, the spike therein piercing the container membrane and the flip top assembly secured to the container and held in place by the cap.

FIG. 8 shows yet another alternate dispenser embodiment 310 comprising a hermetically sealed container 312, a cap 332, and a flip top assembly 372 associated therewith and retained on the container.

Referring to FIGS. 8 and 10, one end 320 of body portion 316 terminates in a tapered neck or throat portion 322 which is unitary with body portion 316. The neck portion 322 defines an opening 324 sealed with a pierceable membrane 326 unitary therewith.

Container 312 is similar to container 12 except that container 312 additionally includes a circumferentially and radially outwardly extending shoulder 317 at the end 320 of body portion 316.

The cap 332 is similar to the cap 232 and includes a cylindrical skirt portion 338 defined by a generally cylindrical wall 340 having a distal terminus 350 and a peripheral circumferential annular edge 351. The cap 332 also includes a unitary dome portion 346 comprising a frustoconical wall 348 which projects unitarily upwardly from the distal terminus 350 of skirt portion 338. The dome portion 346 also includes a circular cross wall 352 which projects unitarily horizontally from a distal terminus 354 of frustoconical wall 348.

The cap 332 also includes a dispensing nozzle 360 having a generally cylindrical portion 362 which projects unitarily longitudinally upwardly from the top of circular cross wall 352 of dome portion 346 and a frustoconical portion 364 which projects unitarily convergently upwardly from the top of cylindrical portion 362 and which terminates into a dispensing orifice 365. An annular shoulder 366 is defined in the region between cylindrical portion 362 and frustoconical portion 364. A generally cylindrical channel 368 defining a dispensing passageway extends centrally axially through the nozzle 360 and terminates into dispensing orifice 365.

Unlike cap 32, which includes a draining spike 78 which is an element separate therefrom, cap 332 includes a draining spike 378 which is unitary with and depends downwardly from the dome portion 346. More particularly, and referring to FIGS. 9 and 10, draining spike 378 comprises a generally cylindrical body portion 382 which extends downwardly and unitarily from cross wall 352 of dome portion 346 and terminates into a pointed conical tip or piercing portion 386. The draining spike 378 is positioned substantially symmetrically about dispensing nozzle 360 along a common longitudinal axis and includes a bore 392 which extends centrally axially through body portion 382 and tip portion 386 and terminates into channel 368 in dispensing nozzle 360. The channel 368 is positioned substantially symmetrically about bore 392 along a common longitudinal axis. The tip portion 386 includes diametrically opposed inner passages 396 and 398 which extend longitudinally between the outer surface of piercing portion 386 and the bore 392. The inner passages 396 and 398 are in fluid flow communication with the bore 392 which, in turn, is in fluid flow communication with the channel 368 to define a draining passageway for the container contents.

In this particular embodiment where the draining spike 378 is unitary with the cap 332, cap 332 is made of the same hard material as the spike 78 such as styrene, acrylonitrile-butadiene-styrene (ABS), and the like.

The cap 332 including a unitary draining spike 378 is particularly suitable for uses wherever a cap of harder material is preferred. In this application, the draining spike need not comprise an element separate from the cap as with the first cap embodiment 32 since the cap is already made of the same hard material required of the draining spike to assure that the membrane 326 is pierced without the bending or breaking of the draining spike.

Dispenser 310 also comprises a flip top assembly 372 including a flip top 374 adapted to be secured over the nozzle 360, a ring 375 including top and bottom surfaces 395 and 397 and adapted to be secured around the neck portion 322 and between the body portion 316 and cap 332, and a flexible elongate arm 376 which extends unitarily between and connects the flip top 374 and the ring 375, and thus connects flip top 374 to container 312.

The flip top assembly 372 is preferably molded and made of a relatively softer material such as low density polyethylene (LDP), high density polyethylene (HDPE), polypropylene (PP), and the like.

The top 374 includes a flat circular head 377 and a cylindrical skirt 379 extending downwardly and unitarily therefrom which defines a socket for receiving the nozzle 360 of cap 332. The head 377 includes a bottom surface from which a plug 383 outwardly protrudes. The arm 376 extends away from the peripheral edge of head 377. The skirt 379 includes a peripheral edge 385 and an inner cylindrical surface 387 (FIG. 8). Inner cylindrical surface 387 includes a first generally cylindrical portion 389 which projects unitarily outwardly from the bottom surface of head 377 and a second generally cylindrical portion 391 which projects unitarily outwardly from the end of cylindrical portion 389 and terminates into peripheral edge 385. An annular shoulder 393 is defined in the region between cylindrical portions 389 and 391.

When the top 374 is secured to the nozzle 360, the peripheral edge 385 of top 374 abuts the top of cross wall 352 of dome portion 346, the shoulder 393 of top 374 abuts the shoulder 366 of nozzle 360, the cylindrical portions 389 and 391 of top 374 complement and frictionally engage the cylindrical portions 364 and 362, respectively, of nozzle 360, and the plug 383 in top 374 covers the dispensing orifice 365 of nozzle 360.

Liquid is dispensed from the container 312 as described below. Initially, the ring 375 of flip top assembly 372 is slid down and around the neck portion 322 of container 312 into abutting and sealing relationship with the shoulder 317 at the end 320 of body portion 316 such that the top surface 395 of ring 375 abuts the peripheral edge 351 of cap 332 and the bottom surface 397 of ring 375 abuts the shoulder 317. The cap 332 is then positioned over the neck portion 322 so as to begin threadable engagement between screw threads 328 and 342 on the neck portion 322 and cap 332, respectively.

The cap 332 is then rotated, relative to the neck portion 322, in a direction which increases the amount of such threadable engagement and causes the spike 378 to move towards the membrane 326, until the cap 332 is fully threaded onto the neck portion 322 and the piercing portion 386 of spike 378 has penetrated the membrane 326 as shown in FIG. 10 thus providing an access to the liquid in the body portion 316 of container 312.

Then, upon squeezing and/or tilting of the container 312, the liquid in body portion 316 may be dispensed through the nozzle 360 via passages 396 and 398 and bore 392 in spike 378, and through the channel 368 and dispensing orifice 365 in nozzle 360.

With the cap 332 fully threaded onto the neck portion 322, the ring 375 of flip top assembly 372 defines a seal gasket which prevents the leaking of liquid contents between the cap 332 and neck portion 322 while the liquid contents are being dispensed.

The ring 375 is particularly useful where a cap made of a harder material, such as cap 332, may used because, unlike the threads 42 in cap 32 which are made of a softer material, the threads 342 in cap 332 may not effectively sealingly engage the threads 328 of neck portion 322 to seal cap 332 and neck portion 322.

The previously described flip top assembly 272 of FIGS. 5–7 can alternatively be used with the cap 332 of FIGS. 8–10, if desired.

We claim:

1. A dispenser comprising:

a hermetically sealed container including a hollow body portion terminating into a threaded neck portion defining an opening sealed with a membrane unitary therewith;

a cap threadedly secured over the neck portion and provided with a dispensing nozzle;

a draining spike within the cap for piercing the membrane when the cap is secured over the neck portion so as to provide access to the interior of the body portion, said draining spike being in fluid flow communication with said dispensing nozzle; and a flip top closure over said dispensing nozzle and retained on said dispenser by a flexible arm unitary with the flip top closure and with the cap.

2. The dispenser of claim 1 wherein the spike comprises an elongated member including a generally cylindrical body portion and a pointed tip portion extending away from the body portion.

3. The dispenser of claim 1 wherein a plurality of peripherally spaced fins extend into a draining passageway defined by the draining spike.

4. The dispenser of claim 2 wherein the dispensing nozzle includes an inner channel, the cylindrical body portion of said spike being nested within said channel.

5. The dispenser of claim 1 wherein the cap includes a dome portion from which said dispensing nozzle extends outwardly, said dome portion defining an inner recess and said dispensing nozzle including an inner channel, said spike comprising an elongated member including a generally cylindrical body portion and a peripheral flange, said cylindrical body portion and said peripheral flange being nested within said channel and said recess respectively.

6. The dispenser of claim 5 wherein said peripheral flange includes a tapered lateral face and said recess includes a tapered lateral surface engaging said lateral face.

7. The dispenser of claim 1 wherein said draining spike is nested within said cap and is made of a material harder than the material of said cap.

8. The dispenser of claim 1 wherein said draining spike is unitary with said cap and is made of the same material as said cap.

9. A cap suitable for providing access to a hermetically sealed container having an externally threaded throat member sealed by a pierceable membrane, the cap comprising:

a dome portion provided with a dispensing nozzle extending outwardly from the dome portion and a flip top closure for the nozzle, the nozzle defining an inner passageway and an inner recess with a tapered lateral surface surrounding the passageway at the proximal end of the nozzle;

a skirt portion unitary with the dome portion and provided with internal threads for engagement with said externally threaded throat member; and a draining spike comprising an elongated member having a generally cylindrical body portion that terminates at the distal end thereof into a piercing tip and a peripheral flange that includes a tapered lateral face, said spike depending inwardly from said dome portion such that said cylindrical body portion and said peripheral flange are nested within the inner channel and recess respectively, and the tapered lateral face engages said tapered lateral surface, said piercing tip penetrating the membrane when the cap is threaded onto said throat member, said cylindrical body portion and said piercing tip together defining a draining passageway in fluid flow communication with said inner channel of said dispensing nozzle.

10. The cap of claim 9 wherein a plurality of peripherally spaced fins extend into the draining passageway defined by said cylindrical body portion of said spike.

11. A dispenser comprising:

a hermetically sealed container including a hollow body portion terminating into a neck portion defining an opening;

a cap removably secured over the neck portion and provided with a dispensing nozzle; and a flip top assembly including a flip top having a skirt and an annular shoulder, and adapted to be removably secured over said dispensing nozzle, and an elongate flexible arm which terminates at the distal end thereof in a unitary ring that is mounted to and fits around the dispensing nozzle, thereby connecting said flip top and said cap, said unitary ring having concentric lower and upper bosses together defining a terraced top surface and a terraced bottom surface, said skirt abutting that portion of the terraced top surface defined by the lower boss and said shoulder abutting that portion of the terraced top surface defined by the upper boss when the flip top assembly is secured over said dispensing nozzle; and said terraced bottom surface complementing and abutting the dispensing nozzle, and in frictional engagement therewith.

12. The dispenser of claim 11 wherein said cap is made of a plastic material having a hardness greater than the plastic material comprising said flip top assembly.

13. The dispenser of claim 11 wherein said dispensing nozzle includes a dispensing orifice, said flip top including a flat head having a bottom surface and a plug protruding outwardly from the bottom surface thereof, said plug covering said dispensing orifice when said flip top is removably secured to said dispensing nozzle.

14. The dispenser of claim 11 and having a draining spike unitary with said cap and in fluid flow communication with the dispensing nozzle; said draining spike terminating into a unitary, solid conical piercing tip and defining a draining passageway to one side of the piercing tip.

15. A dispenser comprising:

a hermetically sealed container including a hollow body portion terminating into a neck portion defining an opening;

a cap removably secured over the neck portion and provided with a dispensing nozzle; and a flip top assembly including a flip top adapted to be removably secured over said dispensing nozzle and an elongate flexible arm connecting said flip top and said cap; and wherein said cap includes a cross wall, said dispensing nozzle including a first generally cylindrical portion projecting unitarily longitudinally upwardly from said cross wall, a second generally cylindrical portion projecting unitarily longitudinally upwardly from said first cylindrical portion, and an annular shoulder therebetween, said flip top including a generally cylindrical skirt portion including a peripheral edge, a first generally cylindrical inner surface extending inwardly from said peripheral edge, a second generally cylindrical inner surface extending inwardly from said first inner surface and an annular inner shoulder therebetween, whereby when said top is removably secured to said dispensing nozzle, said peripheral edge and said annular shoulder of said skirt portion abut said cross wall and said annular shoulder of said cap respectively, and said first and second cylindrical inner surfaces of said skirt portion engage said first and second cylindrical portions of said dispensing nozzle.

* * * * *